US006655775B1

(12) United States Patent
Raman et al.

(10) Patent No.: US 6,655,775 B1
(45) **Date of Patent: *Dec. 2, 2003**

(54) METHOD AND APPARATUS FOR DROP WEIGHT ENCODING

(75) Inventors: Gopalan Raman, Corvallis, OR (US); Charles R. Steinmetz, Corvallis, OR (US)

(73) Assignee: Hewlett-Packard Development Company, L.P., Houston, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1315 days.

(21) Appl. No.: 08/732,864

(22) Filed: Oct. 15, 1996

(51) Int. Cl.[7] ..... B41J 2/01
(52) U.S. Cl. ..... 347/19
(58) Field of Search ..... 347/7, 15, 19

(56) References Cited

U.S. PATENT DOCUMENTS

| | | | | |
|---|---|---|---|---|
| 4,872,027 A | | 10/1989 | Buskirk et al. | 346/140 R |
| 5,033,887 A | | 7/1991 | Bauerle | 400/175 |
| 5,039,237 A | * | 8/1991 | Tanuma et al. | 400/124 |
| 5,049,898 A | | 9/1991 | Arthur et al. | 346/1.1 |
| 5,072,235 A | | 12/1991 | Slowik et al. | 346/1.1 |
| 5,107,276 A | | 4/1992 | Knccczel et al. | 346/1.1 |
| 5,122,816 A | | 6/1992 | Poeppel | 346/76 |
| 5,137,379 A | | 8/1992 | Ukai et al. | 400/121 |
| 5,289,210 A | | 2/1994 | Takayanagi | 346/140 R |
| 5,387,976 A | | 2/1995 | Lesniak | 356/379 |
| 5,477,246 A | | 12/1995 | Hirabayashi et al. | 347/12 |
| 5,504,507 A | * | 4/1996 | Watrobski et al. | 347/19 |
| 5,506,611 A | | 4/1996 | Ujita et al. | 347/86 |
| 5,610,635 A | | 3/1997 | Murray et al. | 347/7 |
| 5,699,091 A | * | 12/1997 | Bullock et al. | 347/19 |
| 5,812,156 A | | 9/1998 | Bullock et al. | 347/19 |

FOREIGN PATENT DOCUMENTS

| | | | |
|---|---|---|---|
| EP | 0315417 | 5/1989 | B41J/3/04 |
| EP | 0626266 | 11/1994 | B41J/2/355 |
| EP | 0626268 | 11/1994 | B41J/25/34 |
| JP | 07248250 | 9/1995 | G01G/9/00 |

* cited by examiner

*Primary Examiner*—Craig Hallacher
(74) *Attorney, Agent, or Firm*—Kevin B. Sullivan

(57) ABSTRACT

The present invention is an inkjet print cartridge for use in an inkjet printing apparatus for forming images on print media. The inkjet print cartridge includes an inkjet printhead that is responsive to print control signals for ejecting ink drops onto print media. The inkjet printhead has a manufacturing tolerances associated therewith producing a range of drop weights. The inkjet printhead has a corresponding drop weight from the range of drop weights. Included with the inkjet print cartridge is an information storage device that is associated with the inkjet printhead for storing information for identifying the corresponding drop weight.

11 Claims, 3 Drawing Sheets

METHOD AND APPARATUS FOR DROP WEIGHT ENCODING

BACKGROUND OF THE INVENTION

The present invention relates to inkjet printers. More particularly, the present invention relates to a technique for encoding drop weight for a particular printhead using resistance values thereby allowing the printer to compensate for manufacturing tolerances of the printhead.

Thermal inkjet printers operate by rapidly heating a small volume of ink and causing the ink to vaporize, thereby ejecting a droplet of ink through an orifice to strike a recording medium, such as a sheet of paper. When a number of orifices are arranged in a pattern, the properly sequenced ejection of ink from an orifice causes characters or other images to be printed upon the recording media as the printhead is moved relative to the recording medium.

The printhead typically includes an orifice plate having very small nozzles through which the ink droplets are ejected. Adjacent to the nozzles inside the printhead are ink chambers, where ink is stored prior to ejection. Ink is delivered to the ink chambers through ink channels that are in fluid communication with an ink supply. The ink supply may be contained in a reservoir proximate the printhead or in the case of "off-axis" printers, the ink supply may be spaced from the printhead.

Ejection of an ink droplet through a nozzle may be accomplished by quickly heating a volume of ink within the ink chamber. Rapid expansion of ink vapor forces ink within the chamber through the corresponding nozzle forming a droplet. This process is called "firing". The ink in the chamber is heated with a heat transducer that is aligned with the corresponding nozzle. Typically, the heat transducer is a resistor, or piezoelectric transducer, but may comprise any substance or device capable of quickly heating the ink.

The inkjet printhead is often mounted in a print cartridge which contains some form of ink reservoir portion. In the manufacture of inkjet print cartridges and more specifically, inkjet printheads, manufacturing tolerances tend to result in variation in drop volume from one printhead to next. This drop volume variation results from manufacturing tolerances in orifice diameter, the heating element formation such as resistor size in the case of a resistive heating element, the ink chamber size, and the ink channel dimensions, to name a few. These manufacturing tolerances all tend to produce variations in ink drop volume from one printhead to the next.

Some printers use techniques such as drop counting to determine an amount of ink remaining. As a result of drop volume variation, it is difficult to determine the amount of ink remaining in the ink cartridge or external ink supply. Therefore, manufacturing tolerances resulting in drop volume variation make drop counting techniques less reliable.

In addition, this drop volume variation effects the output image quality formed on print media. The drops that are ejected onto the print media form small dots on the print media. In the case of text printing the drop volume variation tends to result in dot size variation resulting in poor dot overlap. Poor dot overlap in text images results in poor print quality. In the case of images which are formed having a varying intensities sometimes referred to as "grayscale images" the color intensity or hue is related to the dot density. For example, in color printing frequently cyan, magenta and yellow drops of ink are used to produce a gamut of colors. Drop weight variation among different colors alters the dot size and therefore alters dot coverage which significantly affects the color reproduction. For example, if the magenta drop volume is significantly higher than intended, a hue shift will result in the output image which seriously reduces the printed image quality.

One solution is to make use of manufacturing techniques which produce tighter manufacturing tolerances. One problem associated with this technique is that these manufacturing methods which provide improved tolerances tend to be costly which tend to increase the cost of the inkjet print cartridge.

SUMMARY OF THE INVENTION

The present invention is an inkjet print cartridge for use in an inkjet printing apparatus for forming images on print media. The inkjet print cartridge includes an inkjet printhead that is responsive to print control signals for ejecting ink drops onto print media. The inkjet printhead has a manufacturing tolerance associated therewith producing a range of drop weights. The inkjet printhead has a corresponding drop weight from the range of drop weights. Included with the inkjet print cartridge is an information storage device that is associated with the inkjet printhead for storing information for identifying a corresponding drop weight from the range of drop weights.

In the preferred embodiment the inkjet print cartridge the storage device is a circuit having a resistance value corresponding to the corresponding drop weight for the printhead. In the preferred embodiment, the inkjet printing apparatus receives the inkjet print cartridge. The inkjet printing apparatus includes an information reading device for reading the drop volume information associated with the inkjet printhead. The inkjet printing apparatus makes use of the drop volume information for compensating for the manufacturing tolerance.

DETAILED DESCRIPTION OF THE PREFERRED EMBODIMENT

Figure 1:
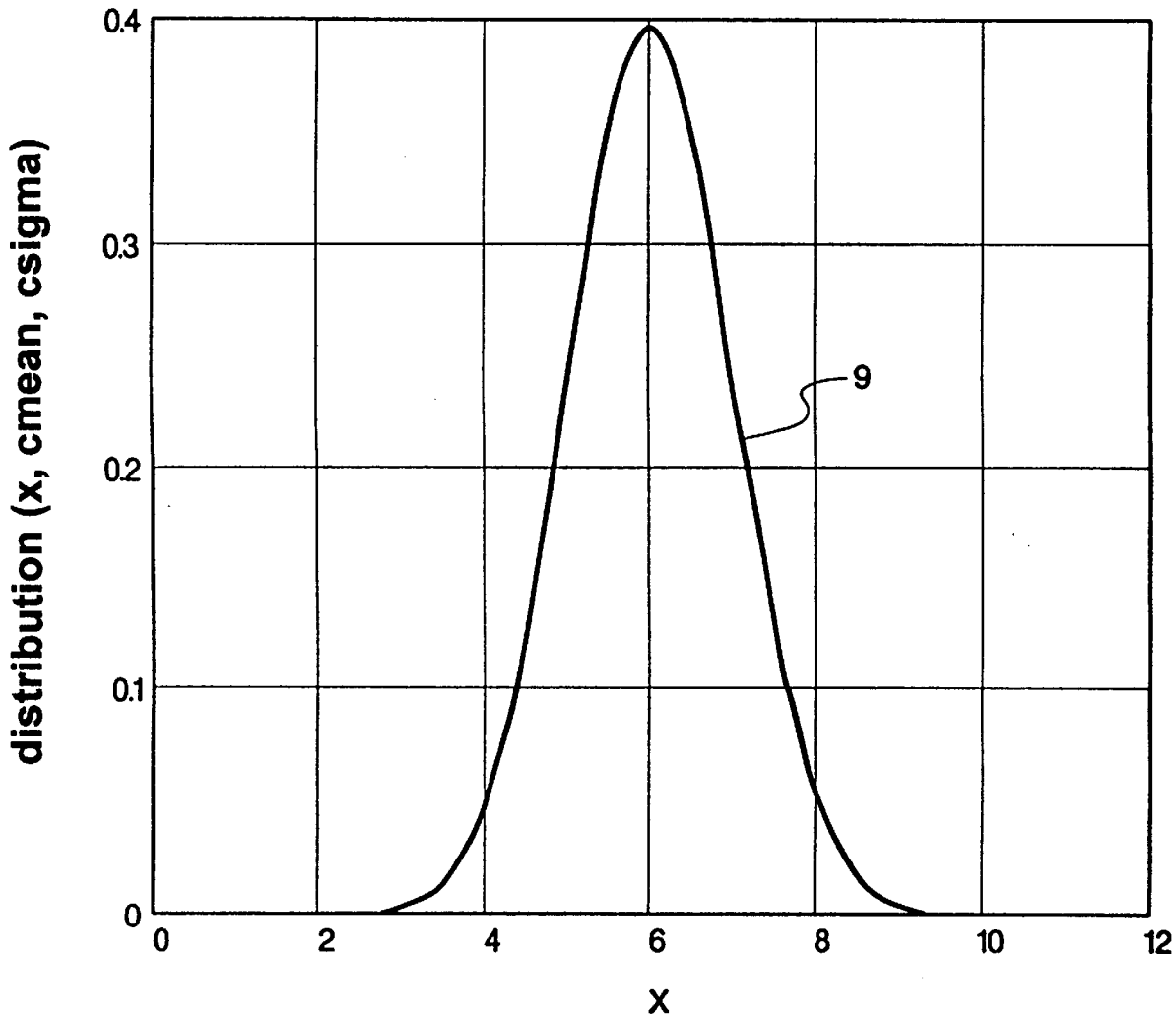
FIG. 1 depicts a drop weight distribution curve for printheads having a nominal drop weight of 6 nanograms.

FIG. 1 depicts a normal or Gaussian distribution curve 9 for an inkjet printhead that is produced in a manufacturing environment. The normal distribution curve 9 tends to be representative of inkjet printheads which are formed in high volume using numerous manufacturing steps with each step having a manufacturing tolerance associated therewith. The distribution curve 9 of FIG. 1 represents a manufacturing process for forming inkjet printheads having a nominal drop weight of 6 nanograms. The distribution function for drop weight variation can be represented by the function shown in equation 1 as follows:

$$F(x)=1/\sigma\sqrt{2\pi}(\exp(-(x-x_0)^2/2\sigma^2)) \qquad \text{Equation 1:}$$

where $x_0$ is the mean drop weight, x is the drop weight and F(x) is the distribution as a function of drop weight. The distribution curve 9 has an x-axis representing drop weight in nanograms and a y-axis representing the distribution function for printheads having a mean (cmean) equal to 6 nanograms and a standard deviation (csigma) equal to 1 nanogram. Therefore, the y-axis is representative of a percentage of printheads having a drop weight shown on the x-axis. This example is used merely to illustrate drop weight variation in printheads formed using similar manufacturing techniques. It is assumed in this example that the printhead manufacturing tolerances can be represented by the normal distribution shown in FIG. 1. In addition, the normal distribution for a 6 nanogram printhead is shown for illustrative purposes, printheads may have different nominal drop weights or different standard deviations. Furthermore, the actual distribution curve may be differ from the normal distribution curve 9 depending on the particular manufacturing methods used.

The drop volume and drop weight are related. Because it tends to be easier to measure drop weight than drop volume the method and apparatus of the present invention utilizes drop weight information. However, the method and apparatus is equally applicable to drop volume information as well.

The area under this curve 9 represents the number of printheads having a given drop weight range. Therefore, using this distribution 68.3 percent of the printheads are within 1 sigma or 1 nanogram of the nominal, 6 nanograms, 95.6 percent are within the 2 sigma range and 99.7 percent are within the 3 sigma range.

Some of the printheads will have drop weights of +/−3 sigma which corresponds to drop weights of 3 nanograms and 9 nanograms. These 3 and 9 nanogram printheads have a drop weight variation that is 50% from the mean of 6 nanograms. Therefore, if printer parameters are chosen for the nominal drop weight of 6 nanograms for instance, then some printheads will be used which will have drop weights of 3 and 9 nanograms toward the outer edge of the manufacturing range. It is likely that this manufacturing tolerance will result in performance problems such as dot overlap problems on the print medium. The variation in print overlap due to drop weight variation tends to reduce the quality of the output image. In addition, printers which use drop counting techniques for monitoring ink consumption may be off by as much as 50% due to this drop weight variation of the printhead.

If the printheads are sorted and only the printheads having a drop weight variation of one sigma from the nominal are used then this would be 68.3 percent of the printheads. The remaining 31.7 percent of the printheads would be unusable resulting in waste as well as increased manufacturing costs.

Figure 2:
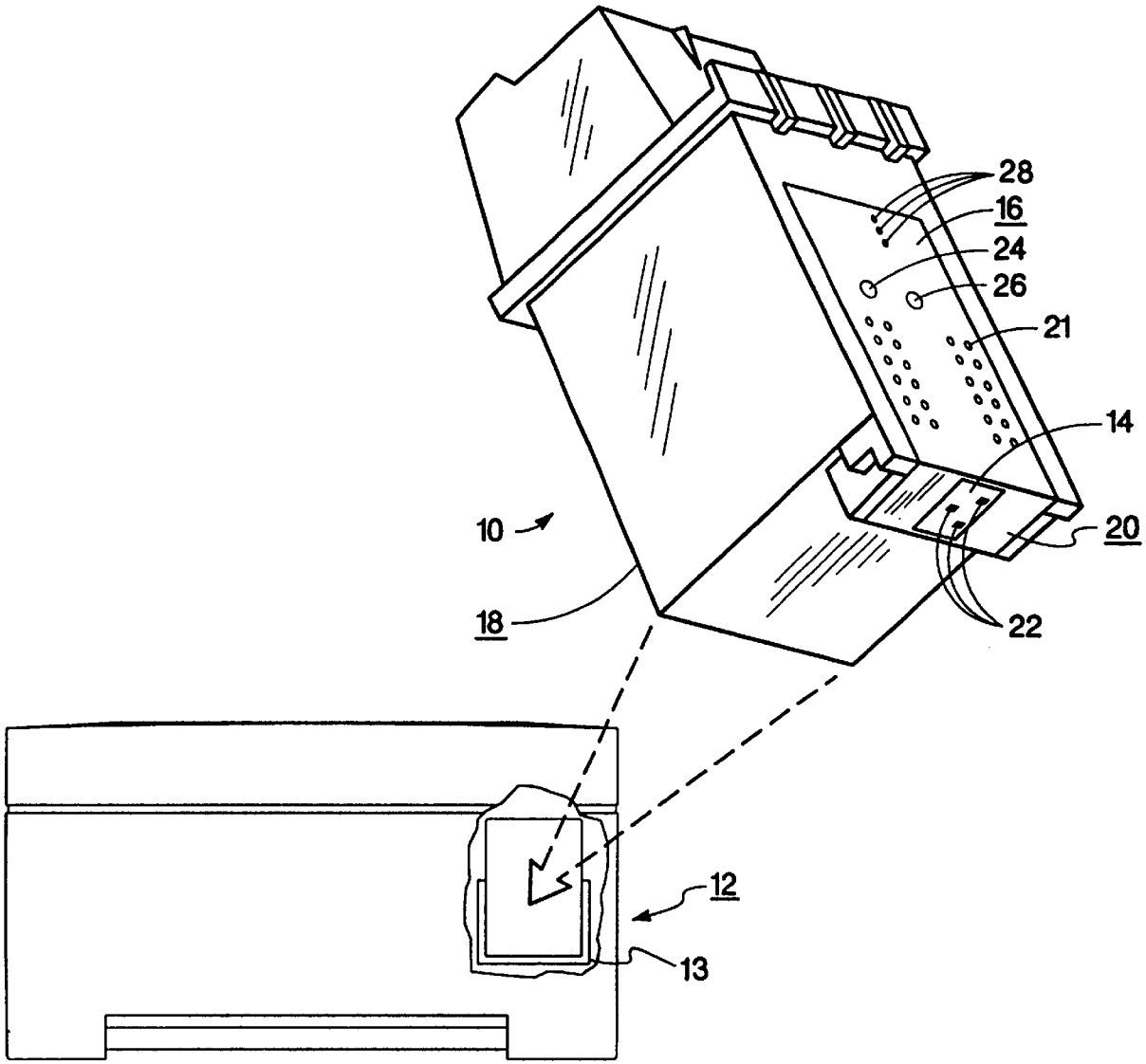
FIG. 2 depicts a print cartridge of the present invention which includes an apparatus for encoding drop weight for the particular printhead.

FIG. 2 depicts a preferred embodiment of the inkjet print cartridge 10 of the present invention for use in the inkjet printer 12 for forming images on print medium. The inkjet printer 12 including a cartridge mount 13 for receiving one or more inkjet print cartridges 10. The inkjet print cartridge 10 includes an inkjet printhead 14 that is responsive to print control signals for ejecting ink drops onto print media. The inkjet printhead 14 has a manufacturing tolerance associated therewith producing a range of drop weights. The inkjet printhead 14 has a corresponding drop weight from the range of drop weights. The inkjet print cartridge 10 includes an information storage device 16 that is associated with the inkjet printhead 14 for storing information for identifying the corresponding drop weight.

In the preferred embodiment, the inkjet print cartridge 10 includes a pen body which defines a reservoir 18. The reservoir 18 is configured to hold a quantity of ink. The printhead 14 is fit to the bottom 20 of the print cartridge 10 and is controlled by electrical interconnects 21 for ejecting ink droplets from the printhead 14. The printhead 14 defines a set of nozzles 22 for expelling ink, in a controlled pattern, during printing. Each nozzle 22 is in fluid communication with a firing chamber (not shown) that is defined within the printhead 14.

In one preferred embodiment, the print cartridge 10 includes an ink supply within the cartridge reservoir 18. Alternatively, the ink cartridge 10 may be configured for use with (off-axis) ink supplies which are spaced from the print cartridge 10 and in fluid communication with the print cartridge 10. Regardless of where the ink supply is located, a supply conduit (not shown) conducts ink from the ink reservoir 18 to one or more ink channels (not shown) defined within the print cartridge 10. The ink channels are configured so that ink moving therethrough is in fluid communication with each of the firing chambers and hence each nozzle 22.

The information storage device 16 in the preferred embodiment is a circuit connected between a pair of terminals 24 and 26. In the preferred embodiment the circuit provides a resistance between the terminals 24 and 26 which is indicative of the drop weight of the particular printhead 14. In this preferred embodiment a series of switches 28 are provided for selecting a resistance value for the circuit between terminals 24 and 26 for identifying the drop weight of the printhead 14.

Figure 3:
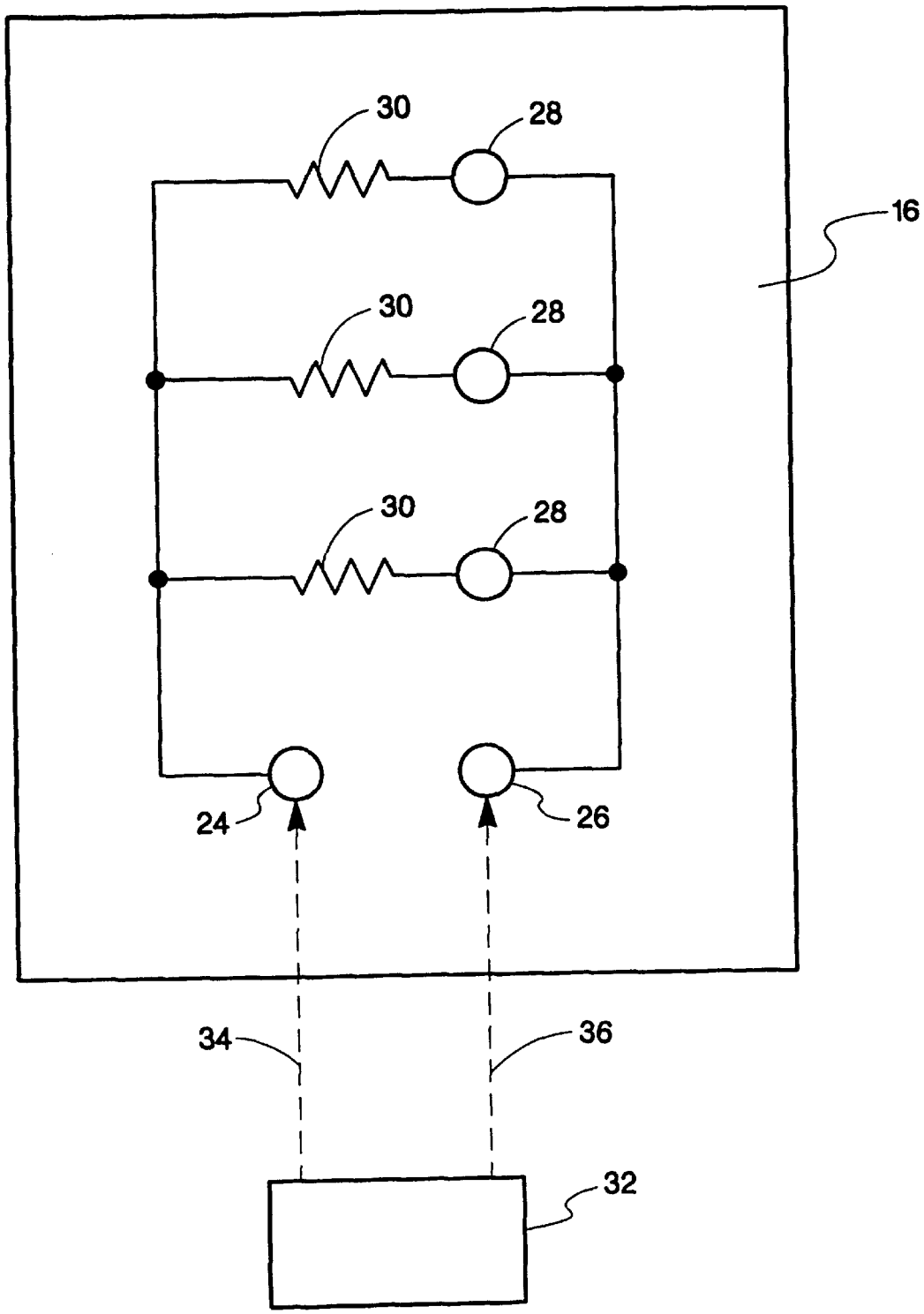
FIG. 3 depicts the preferred embodiment of the present invention for encoding drop weight using a resistive network.

FIG. 3 depicts the preferred embodiment of the storage device 16 for identifying the drop weight of the printhead 14. The storage device 16 includes a plurality of resistors 30 connected in parallel between terminals 24 and 26. Connected in series with each of the resistors 30 are switches 28. The resistance between terminals 24 and 26 are selected by selectively activating switches 28. Once the drop weight of the printhead 14 is determined, the appropriate switches 28 are activated to select a resistance value corresponding to the drop weight of the printhead 14.

An information retrieval device 32 having a pair of terminals 34 and 36 are configured for engaging the corresponding terminals 24 and 26, respectively of the storage device 16 for retrieving the drop weight of the printhead 14 from the storage device 16. In the preferred embodiment, the information retrieval device 32 is a resistance sense circuit that is located on the printer 12. The terminals 34 and 36 are positioned such that when the ink cartridge 10 is properly installed in the printer 12 the terminals 34 and 36 of the information retrieval device 32 are electrically connected to the terminals 24 and 26 of the storage device 16 so that the drop weight information stored in the storage device 16 can be retrieved by the information retrieval device 32 so that the printer 12 can properly compensate for any drop weight variation by the printhead 14.

The storage device 16, in the preferred embodiment, makes use of resistors 30 which have either the same or nearly the same resistance value. For this preferred embodiment, assuming the total value of the resistance for the storage device 16 circuit is equal to $R_1$ where the circuit has n resistors with each resistor has a resistance value of R. For this preferred embodiment the above relationship can be represented by equation 2.

$$1/R_t = n/R \qquad \text{Equation 2:}$$

For the case where one of the resistors R is not connected because the switch 28 is not activated then the resistance between connectors 24 and 26 would be related by equation 3.

$$1/R_t = (n-1)/R \qquad \text{Equation 3:}$$

Using this technique a resistance value is preassigned for each group of drop weights of interest for the printhead 14.

Once the printhead 14 or print cartridge 10 is inserted into the printer 12, the resistance is measured by the information retrieval device 32 of the printer 12 for determining ink usage as well as ink coverage for improving the quality and reliability of the printer 12.

In the preferred embodiment the storage device 16 is formed by a conductive layer such as copper on an insulating layer such a polymer material such as polyimid. The conductive portions are preferably defined using a photolithographic technique and an etching technique. The switches 28 are formed by defining a gap or spacing in the copper conductive traces thereby setting each of the switches 28 to an inactive mode or nonconductive mode. Once the drop weight is determined for the printhead 14, the switches 28 are selectively activated by selectively placing an electrically conductive material between the gaps or spacing in the conductive traces thereby electrically connecting the selected resistor between the pair of terminals 24 and 26. In the preferred embodiment the conductive material is a conductive epoxy is placed between the gaps or spacing for electrically connect the copper traces thereby activating the switch 28. As more resistors 30 are connected in parallel between the pair of terminals 24 and 26 the resistance between the pair of terminals is altered. The number of switches 28 which are activated is related to the drop weight of the printhead 14.

The drop weight of the printhead 14 is determined either directly or indirectly. The direct method for determining the drop weight of the printhead 14 is to fire or eject a known number of drops into a collection pan in a weighing scale. The weight is recorded and the average drop weight can then be determined. The indirect method for determining the drop weight for printhead 14 is by printing a pattern of dots on a medium. The drop weight can then be inferred by spot size. Spot size may be measured using machine vision in the preferred embodiment. The drop weight is then calculated from the spot size based on experimental correlation which is stored in a computer. Based on the data of drop weight, printheads can then be sorted according to ranges of drop weight. For example, the 3–9 nanogram drop weight range as disclosed in FIG. 1 may be subdivided into 3 groups each group consisting of a 1.5 nanogram range. A code is then used to activate or program switches 28 such that when the cartridge 10 is inserted into the printer 12 the printer 12 properly compensates for the drop weight of the particular printhead 14.

Alternatively, printhead parameters such as resistor, orifice, chamber dimensions etc. can be related by a statistical model correlation equation to drop weight based on experimental measurements of drop weight and printhead parameters. For a given printhead knowing the critical dimensions, a drop weight can be calculated based on model equation and the pen can be encoded with this drop weight using the apparatus of the present invention.

The storage device 16 has been described as a resistor array which has a resistance value that is selectable or programmable. Alternatively, the storage device 16 can be a variety of devices for storing information indicative of drop weight for the printhead. For example, the storage device 16 can be a plurality of capacitive elements that are configured to provide a known capacitive value representative of drop weight. The information retrieval device 32 is capable of determining the drop weight based on the capacitance value. Alternatively, the storage device 16 can be a label having an indicia indicative of drop weight. The label is affixed to the print cartridge 10 once the drop weight is determined. The information retrieval device 32 within printer 12 is a label reading device for determining the printhead drop weight. In another alternative embodiment the storage device 16 is some form of electronic memory such as a read only memory (ROM), read access memory (RAM) or some form of programmable device such as electrically erasable read only memory (EEPROM) for storing drop weight information. The information retrieval device 32 within printer 12 for these examples is a suitable device for reading drop weight information from these devices.

The present invention provides a low cost technique for identifying or tagging printheads by drop weight. In the case of color printers drop weights for each of the colors can be encoded or identified by the printhead. The printer which these printheads are installed are capable of reading these tags or drop weight information, thus allowing the printer to compensate for drop weight variation from printhead to printhead. By providing this drop weight information to the printer the printer is capable of forming high quality output images using printheads having a wide range of drop weights. Because printheads having a wider range of drop weights can be used the manufacturing costs of the printhead is reduced.

What is claimed is:

1. An inkjet print cartridge for use in an inkjet printing apparatus for forming images on print media, the inkjet print cartridge comprising:

a pen body;

an inkjet printhead mounted to the pen body for ejecting ink drops onto print media, the inkjet printhead having a manufacturing tolerance associated therewith and producing a corresponding actual drop weight for said printhead which is dependent on the manufacturing tolerance in a range of drop weights; and an information storage device supported by the pen body and associated with the inkjet printhead for storing information for identifying said corresponding actual drop weight for said printhead, said information readable by the inkjet printing apparatus.

2. The inkjet printhead of claim 1 wherein the information storage device is a circuit having a resistance value corresponding to the corresponding drop weight for the printhead.

3. The inkjet printhead of claim 1 wherein the corresponding drop weight is a first range of drop weights selected from the range of drop weights resulting from the manufacturing tolerance.

4. The inkjet printhead of claim 1 wherein the information storage device includes a switch device for indicating the drop weight.

5. The inkjet print cartridge of claim 1 wherein said information is encoded as one value from a predetermined discrete set of possible values, and each of said possible values corresponding to a subrange of drop weights within said range of drop weights.

6. A method for encoding an inkjet print cartridge for use in an inkjet printer, the cartridge including a pen body, an inkjet printhead supported by the body, and an information storage device associated with the printhead and carried by the pen body, the method comprising the steps of:

determining an actual drop weight for the inkjet printhead; and encoding data corresponding to the actual drop weight for the inkjet printhead in the information storage device associated with the inkjet printhead, the data being encoded in a form which is readable by the inkjet printer.

7. The method for manufacturing an inkjet printhead of claim 6 wherein the inkjet printhead has a manufacturing tolerance producing the range of drop weights and wherein determining the particular drop weight for the inkjet printhead is accomplished by sorting inkjet printheads by drop weight.

8. The method for manufacturing an inkjet printhead of claim 6 wherein encoding the particular drop weight comprises configuring a resistive network to provide a selected resistance between a pair of terminals, the pair of terminals configured for engagement with corresponding printer terminals for compensating for drop weight variation.

9. An inkjet printing system for forming images on print media, the inkjet printing system comprising:

inkjet print cartridge apparatus including pen body apparatus, printhead apparatus carried by the pen body apparatus for ejecting ink onto print media, and information storage apparatus supported by the pen body apparatus, the inkjet printhead apparatus having a manufacturing tolerance associated therewith producing a range of possible drop volumes said inkjet printhead apparatus having a corresponding actual drop volume due to the manufacturing tolerance;

the information storage apparatus having drop volume information associated with the inkjet printhead apparatus stored therein, said drop volume information determined by said corresponding actual drop volume;

a printer configured for receiving the inkjet print cartridge apparatus for forming images on print media, the printer including an information reading device for reading the drop volume information associated with the inkjet printhead apparatus, the printer using the drop volume information for compensating for the manufacturing tolerance.

10. The inkjet printing system of claim 9 wherein the inkjet printhead apparatus is a plurality of printheads each having a different color associated there with and the information storage device has drop volume information associated with each of the plurality of printheads and wherein the printer includes an information reading device for reading drop volume information associated with each of the plurality of printheads for compensation for any manufacturing tolerance thereby preventing hue shift in output images.

11. A method for encoding an inkjet print cartridge including a pen body, an inkjet printhead mounted to the pen body, and an information storage device associated with the printhead and attached to the pen body, and using the encoded print cartridge in an inkjet printer, the method comprising the following steps:

determining an actual drop weight for the inkjet printhead associated with a particular manufacturing tolerance for the printhead;

encoding the actual drop weight for the inkjet printhead in the information storage device;

installing the inkjet print cartridge in an inkjet printer;

reading the drop volume information associated with the inkjet printhead; and using the drop volume information to compensate for the manufacturing tolerance during printing operations.

* * * * *